US005547249A

United States Patent [19]

Riley et al.

[11] Patent Number: 5,547,249

[45] Date of Patent: Aug. 20, 1996

[54] STABILIZING DEVICE FOR USE WITH COVERS AND CUSHIONS ON SEATING AND UPHOLSTERED FURNITURE

[75] Inventors: Paula Riley, New York; Kenneth V. Stevens, Greenpoint, both of N.Y.

[73] Assignee: Prescient Partners, L.P., New York, N.Y.

[21] Appl. No.: 270,057

[22] Filed: Jul. 1, 1994

[51] Int. Cl.[6] ..... A44B 21/00

[52] U.S. Cl. ..... 297/228.13; 24/304; 24/462; 297/226; 297/229

[58] Field of Search ..... 24/460, 462, 72.5, 24/304, DIG. 11; 297/229, 226, 225, 228.13; 49/489.1; 52/716.3, 717.03, 717.05; 160/392, 395

[56] References Cited

U.S. PATENT DOCUMENTS

| | | | |
|---|---|---|---|
| 671,727 | 4/1901 | Hipolito et al. | 160/395 |
| 2,526,376 | 10/1950 | London | 24/462 X |
| 2,601,890 | 7/1952 | Smith | 297/229 |
| 2,776,705 | 1/1957 | Robinson | 297/229 |
| 2,835,325 | 5/1958 | Gilbert et al. | 160/395 X |
| 3,205,547 | 9/1965 | Riekse | 24/462 |
| 3,612,607 | 10/1971 | Lohr . | |
| 3,991,806 | 11/1976 | Abell | 160/392 X |
| 4,799,299 | 1/1989 | Campbell | 24/462 |
| 5,009,540 | 4/1991 | Nolan | 160/392 X |
| 5,380,120 | 1/1995 | Vermeulen | 24/462 X |

FOREIGN PATENT DOCUMENTS

| | | | |
|---|---|---|---|
| 77125 | 12/1961 | France | 24/462 |
| 1950288 | 4/1971 | Germany | 297/226 |
| 3513076 | 10/1986 | Germany | 297/226 |
| 303282 | 1/1929 | United Kingdom | 297/229 |

*Primary Examiner*—James R. Brittain
*Attorney, Agent, or Firm*—Morgan & Finnegan, L.L.P.

[57] ABSTRACT

A stabilizing device comprises an elongated V-shaped timber having a nose and a pair of arms forming the V-shape. The member is made of an elastic material such that the pair of arms are collapsible from a first naturally open stable position to a second unstable closed position without undue force.

40 Claims, 4 Drawing Sheets

STABILIZING DEVICE FOR USE WITH COVERS AND CUSHIONS ON SEATING AND UPHOLSTERED FURNITURE

FIELD OF THE INVENTION

The present invention relates generally to stabilizing devices for securing fabric covers on furniture. More specifically, the present invention relates to an elongated stabilizing device having a V-shaped cross section.

BACKGROUND OF THE INVENTION

The use of fabric throw covers on upholstered furniture has become very popular in recent years. The throw covers can vary in size ranging from, for example, a 100" by 90" cover for chairs to a 100" by 170" cover for large sofas. Conventionally, after the throw cover has been loosely placed on the sofa, the user will hand tuck the fabric cover into the spaces between the seat cushion and the back and between the seat cushion and the arms at each side of the seating perimeter. However, after the throw cover has been tucked in place problems quickly arise due to the normal use of the furniture. In other words, the normal movements of a person such as siring, adjusting one's position while seating, and/or getting up from the sitting position all tend to displace the position of the throw cover. The appearance of the throw cover quickly becomes unsightly because it is wrinkled, bunched up and out of place. Accordingly, to maintain the proper and desired position for the throw cover, the user must continuously adjust, smooth and retuck the throw cover.

Some of the foregoing problems have been resolved by U.S. Pat. No. 517,306 which discloses a device for fastening slip covers on upholstered furniture. The device includes several clip like relatively narrow fasteners E that are connected to a rod F. Each fastener has teeth $E_4$ at the end of arms $E_2$. As illustrated in FIG. 3 of this patent, in use the teeth $E_4$ penetrate into the slip cover C and the cushions A, B. Unfortunately, this type of device will immediately damage and eventually destroy the slip cover C, as well as the cushions A, B by making holes in each. In addition, this device is quite cumbersome to insert because each clip must be simultaneously compressed. Otherwise, the teeth may catch on the fabric of the cover and/or the cushions. This device is also difficult to remove once in place because each clip must be individually compressed and disengaged from the cushions and the slip cover, and then all of the compressed clips must be removed simultaneously. Other problems with this device are that the fastener can be easily moved out of position, i.e., dislodged, if the slip cover is moved laterally, and that multiple fasteners must be used along each length.

It is, therefore, an object of the present invention to provide a stabilizing device that permits the cover to be initially tucked in place on the upholstered furniture in a desired position and thereafter prevents its relative movement with respect to the upholstered furniture during the normal use while simultaneously preventing damage to the throw cover. It is a further object for an elongated stabilizing device to be used, one preferably made of an elastic material to hold the slip cover uniformly along the edge of the fabric so that there is a reduced tendency to tear or deform the fabric. It is a still further object to permit the use of a single continuous one piece unitary stabilizing device for each length of cushion to be tucked in place.

It is another object of the present invention to provide a stabilizing device that requires few parts and, thus, is easy to manufacture. It is still a further object of the present invention that the stabilizing device be simple and cost effective to manufacture, yet reliable and efficient in use.

SUMMARY OF THE INVENTION

In accordance with a preferred embodiment demonstrating further objects, features and advantages of the present invention, the stabilizing device includes an elongated member having a pair of arms forming the V-shape. The member is preferably made of an elasticity such that pair of arms are collapsible from a first naturally open stable position to a second unstable closed position without undue force.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENTS

Figure 1:
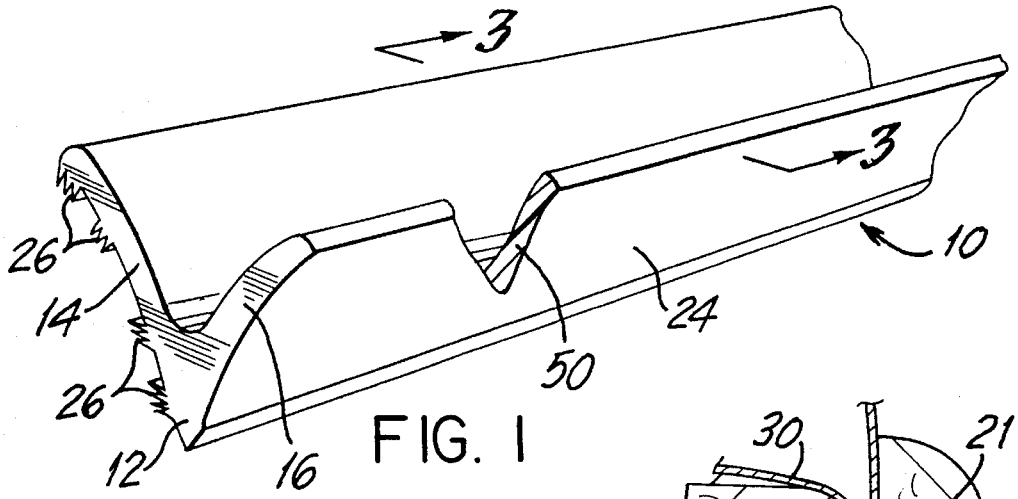
FIG. 1 is a perspective view of a stabilizing device according to the present invention.

Referring now to FIG. 1, a stabilizing device 10 according to the present invention is illustrated. The stabilizing device is an elongated member and has a V-shaped cross section as illustrated in FIGS. 3A through 3E. The elongated member has a nose section 12 and a pair of arm sections 14, 16, which forms the V-shape.

Figure 5:
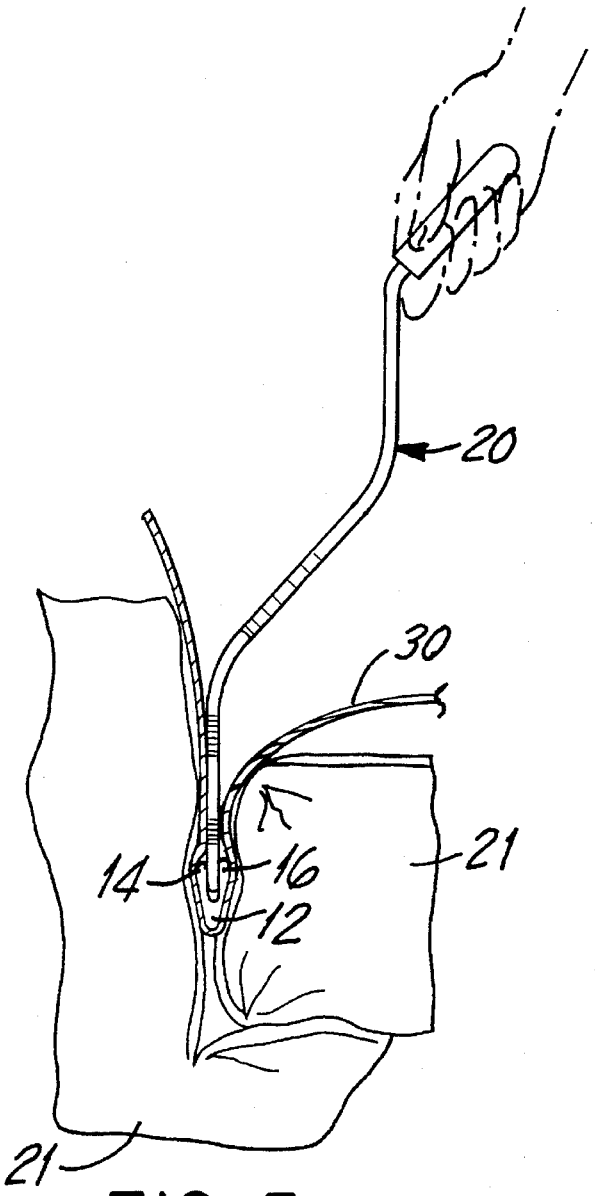
FIG. 5 is a sectional view of the stabilizing device as it is about to be placed between adjacent furniture cushions.

The elongated member is preferably made of an elastic material, such that the material has an elasticity to ensure that the pair of arms are moveable with a moderate amount of force from a first naturally open or stable position, as illustrated in FIGS. 2 and 3A–3E, to a second closed unstable position when the elongated member is being installed between adjacent furniture cushions 21 as illustrated in FIG. 5. The elasticity will of course vary depending upon the dimensions of the elongated member. However, the elasticity can be easily determined by one skilled in the an such that the member is sufficiently elastic to enable insertion without undue force and to maintain pressure on the fabric cover and cushion while not dislodging the cushion from its intended position. This elasticity is necessary to enable the member to be inserted with minimal force and after the member is in place, to permit the member to return to or towards its open position to continually apply force to the fabric and cushion because the internal forces in the member urge it back towards the initial stable position.

Figure 2:
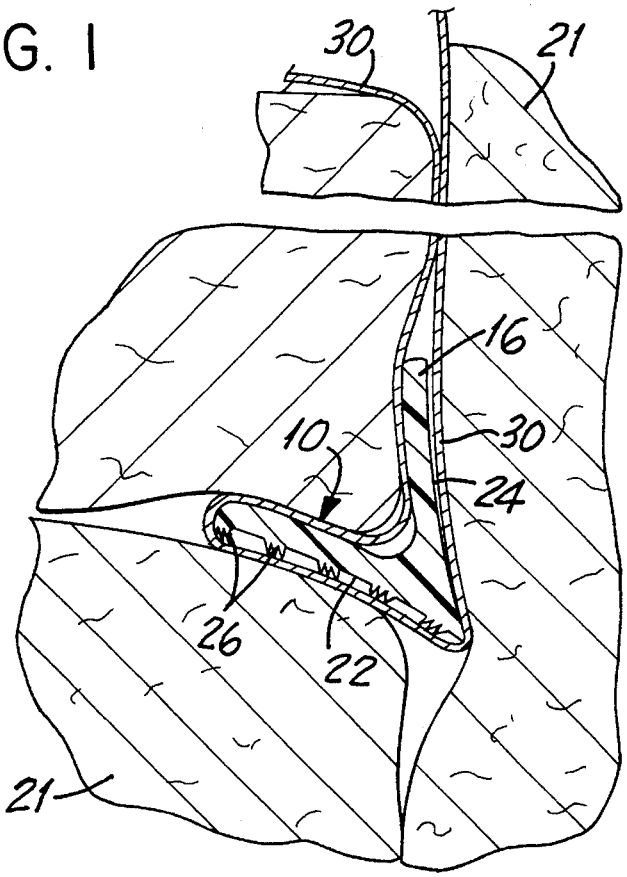
FIG. 2 is a sectional view of the stabilizing device installed into a space between adjacent furniture cushions.
Figure 3A:
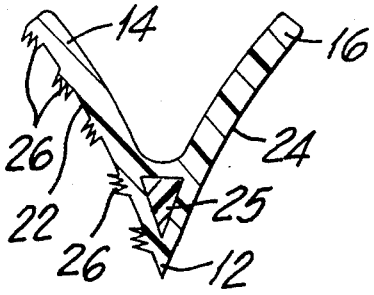
FIGS. 3A, 3B, 3C, 3D and 3E are sectional views taken along lines 3—3 of FIG. 1 and looking in the direction of the arrow.
Figure 3B:
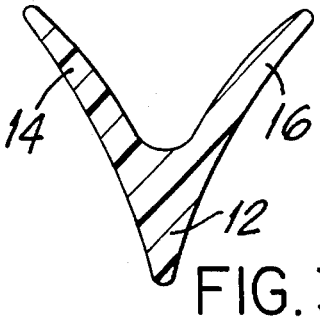
Figure 3C:
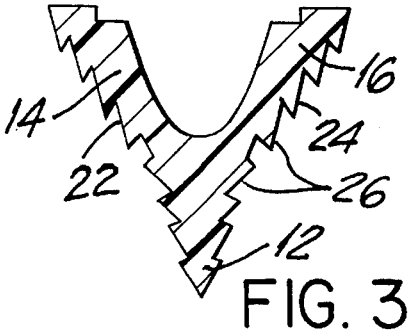
Figure 3D:
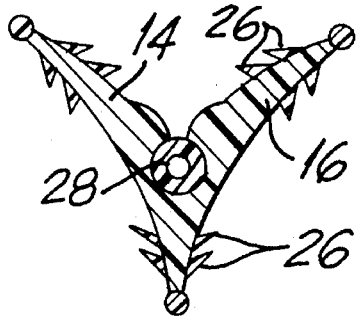
Figure 3E:
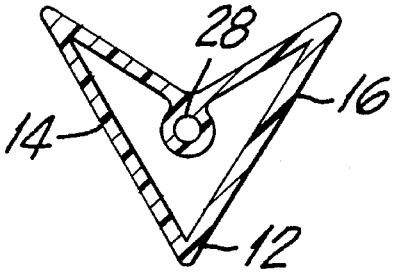
Figure 4:
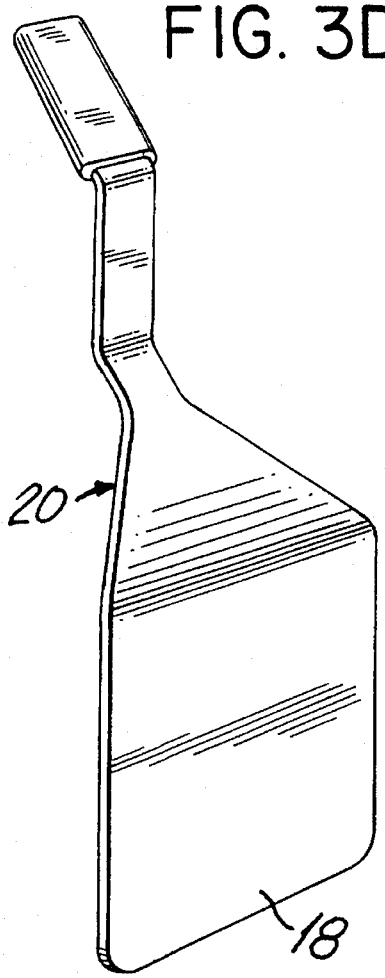
FIG. 4 is perspective view of a tool to be used to place the stabilizing device into the space between adjacent furniture cushions.

In a preferred embodiment of the present invention, the outer surfaces 22, 24 of each arm 14, 16, have a plurality of ribbed projections 26 that are integrally formed with the outer edge to prevent the fabric cover 30 from moving with respect to the stabilizing device. While it is preferred that the ribbed projections 26 be on both outer surfaces 22, 24, the ribbed projections 26 can be disposed on only one of the arms as illustrated in Figs. 1, 2 and 3A or not used at all as illustrated in FIG. 3B and 3E. In addition, the ribbed projections 26 can be disposed on the outer surface of any of the embodiments of the present invention. As stated above, the ribbed projections 26 are designed to prevent the fabric cover from moving with respect to the stabilizing device. However, they are designed so as to not penetrate into the fabric cover 30 or the cushions. Thus, neither the fabric cover 30 nor the cushions will be damaged by the use of the stabilizing device 10. In an alternative embodiment, in lieu of the ribbed projections, the surfaces 22, 24 can be coated with a tacky or an adhesive material, which would perform the same function as the ribbed projections 26. For example, a strip of two-sided tape can be attached to each of the outer surfaces 22, 24. Immediately prior to use, the user can remove a protective strip of wax type paper from the outer surface of the two-sided tape.

The elongated stabilizing device shown in FIG. 3B illustrates the basic design for the present invention. FIG. 3C illustrates another embodiment of the stabilizing device where the outer surfaces 22, 24 of the arms 14, 16 have a continuous ribbed section 26. Thus, the embodiment illustrated in FIG. 3C will impart a greater resistance upon the fabric cover 30 than the embodiment illustrated in FIG. 3B.

Another variation of the present invention is illustrated in FIG. 1, where one of the arms 16 may have one or more V-shaped notches 50 cut out from outer surface 26. The cut out notches 50 permit the device to be tucked into non-linear contours of furniture. The arm containing the cut out notch is preferably placed along the concave portion of the curve so that it may compress along the curve.

Figure 8:
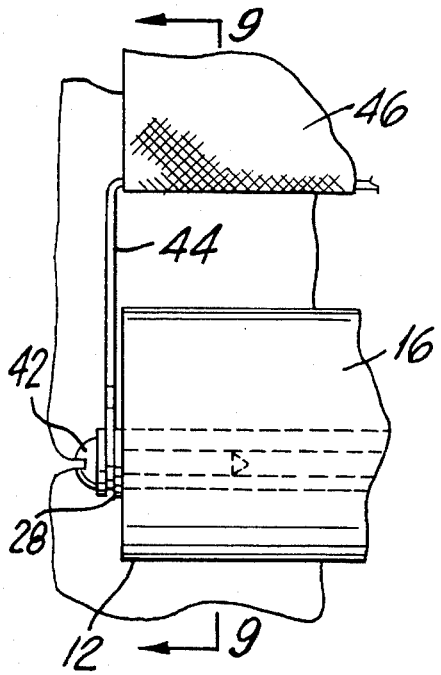
FIG. 8 is a partial end elevation view of the stabilizing device of FIG. 3E being used to stabilize the position of a specialty cushion.
Figure 9:
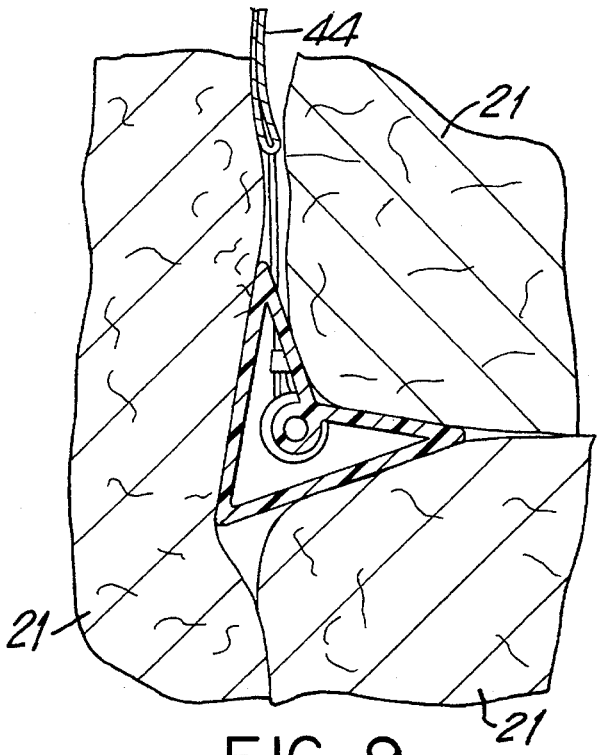
FIG. 9 is a sectional view taken along lines 9—9 of FIG. 8.

Another embodiment of the present invention is illustrated in FIG. 3E, where the stabilizing device is a hollow elongated member having a nose 12 and arms 14, 16. The core section 28 of the elongated device has a hollow cylindrical shape. Thus, a fastener member 42 or hook member can be inserted into the axial open ends of the core 28. A cord, strap, chain or other type of tie 44 can be attached to the stabilizing device at one end and to a specialty cushion, such as a lumbar cushion bolster 46, at the other end of the tie (see FIGS. 8 and 9). In the embodiment illustrated in FIG. 3D, the core portion 28 has a hollow cylindrical shape. This open core allows the arms 14, 16 of the elongated member to be connected to an adjacent elongated member or any other structure by simply making a mechanical connection with the open axial end of the core 28.

Figure 6:
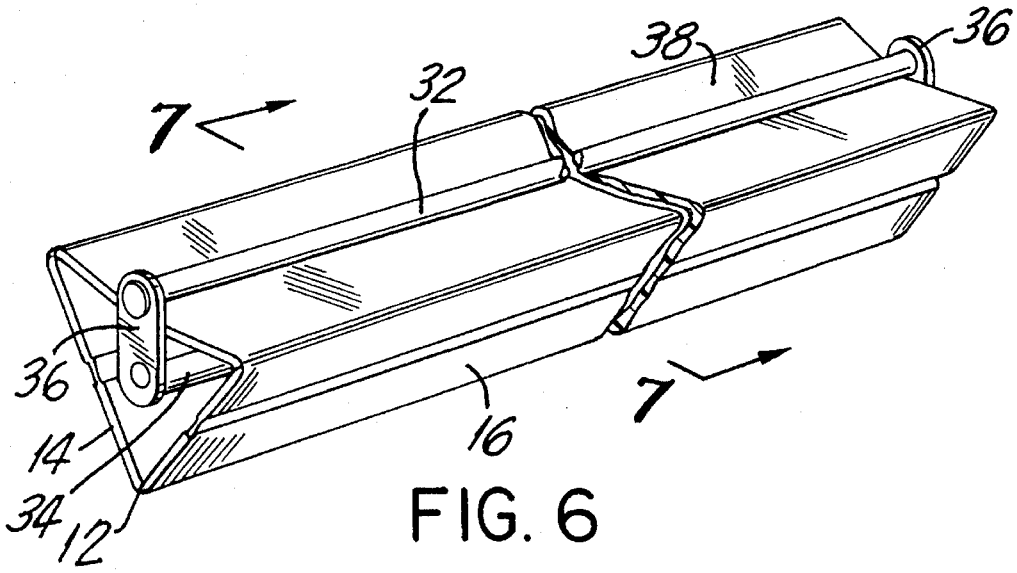
FIG. 6 is a perspective view of another embodiment of the stabilizing device according to the present invention.
Figure 7A:
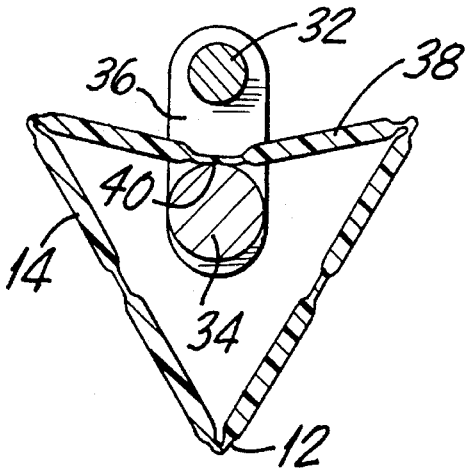
FIGS. 7A and 7B are sectional views taken along lines 7—7 of FIG. 6.
Figure 7B:
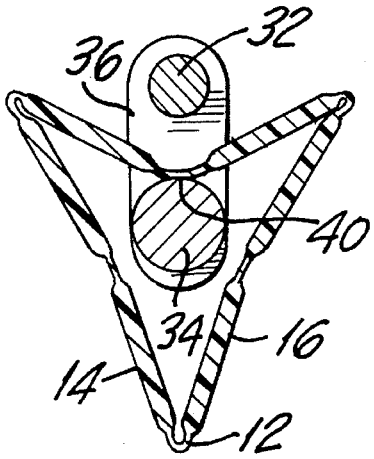

FIGS. 6, 7A and 7B illustrate another embodiment of the present invention. In this embodiment, a pair of elongated bar members 32, 34 are attached to the elongated member. The bar members 32, 34 are rigidly coupled to one another by a pair of links 36 disposed at each axial end of the bar members 32, 34. In addition, bar member 34 is attached to a rear wall portion 38 of the elongated member along an arc shaped section 40. When the device is being placed between adjacent cushions of the furniture, it will assume the shape illustrated in FIG. 7B. Once the stabilizing device is in place, it will then revert to or approach the shape illustrated in FIG. 7A due to the natural forces of the elastic material of the device.

As discussed above, the stabilizing device of the present invention is preferably made by extrusion. However, the stabilizing device can also be made by cold-molding, co-extrusion, blow molding or even by injection molding. Additionally, the stabilizing device can be made from flexible plastic or elastic material. For example, the stabilizing device can be made from polyvinylchloride (pvc), thermoplastic or thermosetting robber or polystyrene.

In the embodiment of the present invention illustrated in FIG. 3A, the nose 12 of the elongated member can include a core portion 28. In a preferred embodiment, a shore A durometer hardness of the core portion 28 ranges from 70 to 80. the remainder of the elongated member, including the arms 14, 16 preferably has a shore A hardness ranging from 50 to 90. Thus, the core section is more rigid than the pair of arms 14, 16. This core section, with increased stiffness with respect to the arm sections, helps increase the torsional resistance of the stabilizing device while maintaining the flexibility of the arm sections to move from a first natural open position to a second closed position. In addition, the elongated member can comprise three different sections each having a different shore A durometer hardness. For example, the arm sections 14, 16 can have a shore A durometer hardness ranging from 70 to 80, the tip of the arms can range from 60–70, and the core section 28 can range from 85 to 95. In the currently preferred embodiments the elongated member is made from a material having a uniform hardness. The shore A durometer hardness may range from 45 to 105 with a preferred range for polyvinylchloride being from 50 to 85. In fact, in one embodiment the shore A durometer hardness is about 76.

Figure 10A:
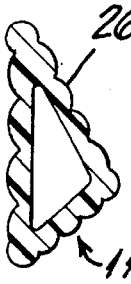
FIG. 10A, 10B, 10C, 10D, 10E, 10F and 10G are sectional views of various different embodiments of the present invention.
Figure 10B:
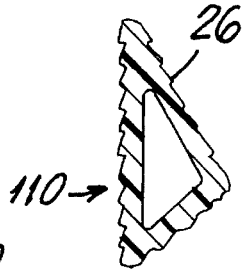
Figure 10C:
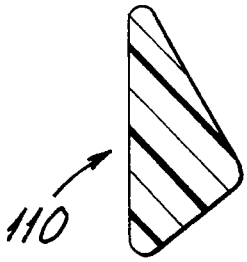
Figure 10D:
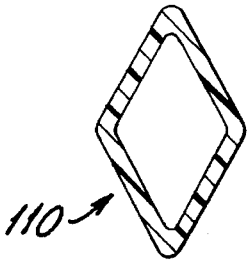
Figure 10E:
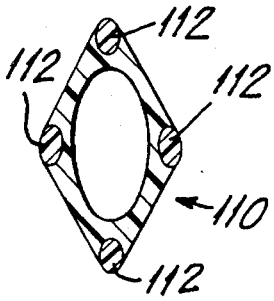
Figure 10F:
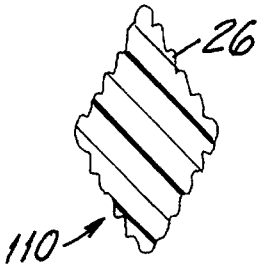
Figure 10G:
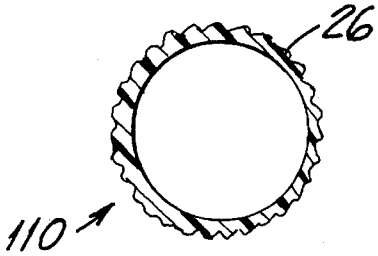

The shape of the elongated member of the present invention is not limited to a V-shape and can take on various different shapes in cross-section such as an X-shape or the cross-sections illustrated in FIGS. 10A–10G. In each of the embodiments illustrated in FIGS. 10A–10G, the elongated member 110 has a closed shape. The embodiments in FIGS. 10A, 10B and 10C are triangular in shape, the embodiments in FIGS. 10D, 10E and 10F are diamond shaped in cross-section, and the embodiment illustrated in FIG. 10G is circular in cross-section. The embodiments illustrated in FIGS. 10C and 10F are solid and the embodiments illustrated in FIGS. 10A, 10B, 10D, 10E and 10G are hollow. Of course, any of these embodiments can include the ribbed shaped projections 26 that are currently illustrated in the embodiments of FIGS. 10A, 10B, 10F and 10G. The embodiment illustrated in FIG. 10E includes nose sections 112 disposed at each of its comers. The nose sections 112 can be made of a softer material than the remainder of the elongated member.

The use of the stabilizing device according to the present invention will be described below with reference to FIGS. 2 and 5. The user first places the throw cover 30 on the furniture. The user then places the stabilizing device 10 at the intersection between adjacent cushions 21 with the nose 12 of the elongated member pointing at the intersection and the nose and the outer surfaces 22, 24 of the arms 14, 16 being in contact with the cover 30. In other words, the cover 30 is disposed between the stabilizing device 10 and the cushions 21. The stabilizing device is preferably a single one piece device whose length is approximately equal to the cushion length. The user then tucks the stabilizing device and cover into the space between the adjacent cushions through the use of a spatula type tool 20 as illustrated in FIG. 5. As the cover is being tucked into place, the resilient arms 14, 16 of the stabilizing device move from the first natural open position to a second closed position. The entire length of the stabilizing device need not be tucked in simultaneously. The device can be tucked in sequentially by starting at one end and, in an accordance type manner, move toward the other end of the elongated device. Of course, the device is preferably flexible in the longitudinal direction to effect such a sequential tucking. However, the stabilizing device can be made from a relatively rigid material which would not permit a sequential tucking. In the second closed position, the arms 14, 16 of the elongated member contact the outer edges 18 of a tool 20. If one were not using a tool to install the elongated member, the arms 14, 16 might actually contact each other. Thus, in the second closed position, the pair of arms 14, 16 are moved closer or become adjacent to one another, and in the first open position, the pair of arms 14, 16 are spaced apart from one another, as illustrated in FIG. 2.

Once the stabilizing device and cover 30 have been tucked into the desired position, the user simply removes the tool, leaving the stabilizing device and cover 30 in the space between the adjacent cushions 21 as illustrated in FIG. 2. The user then proceeds to insert the remaining stabilizing devices into the remaining adjoining cushion intersections. Typically, a chair will require the use of three stabilizing devices. One stabilizing device will be placed at the intersection between the seat cushion and the chair back and the remaining two stabilizing devices, are placed at the intersections between the seat cushion and the sides of the chair. It follows that a love seat will generally require four stabilizing devices and a sofa will require five stabilizing devices. As discussed above, the stabilizing device itself will generally have a length approximating that of the cushion width. For example, the stabilizing device will preferably be at least 4" long, and most desirably about 18" to 24" in length. In addition, the length of the outer surface of each arm may have a width ranging from ½" to 3", with a preferable length of approximately 1¾". Therefore, the preferred dimensions of the elongated member are 1¾"×1¾"×18" or 1¾"×1¾"×24" . Of course, the length of the elongated member may be cut to the desired length by the user depending on the dimensions of the cushion. Therefore, the stabilizer is preferably made of a material which can easily be cut to length by the user.

Having described the present invention and the preferred exemplary embodiments of a new and improved stabilizing device, it is believed that other modifications, variations and changes will be suggested to those skilled in the art. It is, therefore, to be understood that all such variations, modifications, and changes are to fall within the scope of the present invention as defined by the appended claims.

What I claim is:

1. A stabilizing device comprising:

an elongated V-shaped member having a solid nose formed as a substantially triangular configuration, including a base having two substantially flat surfaces tapering to an outer point having a radius of sharp curvature, and a pair of spaced arms forming the V-shape extending outwardly from said base opposite said point and forming substantially continuous, opposing outer flat surfaces extending from the outer point and along the base and spaced arms, the base and arms forming an opposite curved surface with an inner radius of smaller curvature than the curvature of the point, wherein said member is made of an elastic, polymeric material having an elasticity such that said pair of arms are moveable from a first naturally open stable position to a second closed unstable position in which an outward biasing action from the arms can be exerted when the stabilizing device is received within a crevice formed below cushions and adjacent the back or sides of an upholstered piece of furniture to hold a fabric cover positioned over a cushioned seat of the furniture with a portion of the cover disposed within the crevice around the stabilizing device.

2. The stabilizing device according to claim 1, wherein in said second closed position said pair of arms are adjacent to one another.

3. The stabilizing device according to claim 2, wherein in said first open position said pair of arms are spaced apart from one another and an outer surface of at least one of said pair of arms have means for preventing a fabric cover from moving with respect to said at least one of said pair of arms by creating frictional forces between said cover and said outer surface.

4. The stabilizing device according to claim 3, wherein said elastic material has a shore A durometer hardness ranging from 50–90.

5. The stabilizing device according to claim 4, wherein said elastic material is polyvinylchloride.

6. The stabilizing device according to claim 3, wherein said preventing means is a plurality of ribbed projections.

7. The stabilizing device according to claim 3, wherein said preventing means is a coating of tacky or adhesive material.

8. A stabilizing device comprising:

an elongated V-shaped member having a nose and a pair of arms forming the V-shape, said nose including a core portion, said pair of arms being made of an elastic material and said core portion being made of a material more rigid than said pair of arms, and said pair of arms being moveable from a first naturally open stable position to a second closed unstable position.

9. The stabilizing device according to claim 8, wherein in said second closed position said pair of arms are adjacent to one another.

10. The stabilizing device according to claim 9, wherein in said first open position said pair of arms are spaced apart from one another and an outer surface of at least one of said pair of arms have means for preventing a fabric cover from moving with respect to said at least one of said pair of arms by creating frictional forces between said cover and said outer surface.

11. The stabilizing device according to claim 10, wherein said elastic material has a shore A durometer hardness ranging from 50–90.

12. The stabilizing device according to claim 11, wherein said elastic material is flexible polyvinylchloride.

13. The stabilizing device according to claim 10, wherein said preventing means is a plurality of ribbed projections.

14. The stabilizing device according to claim 10, wherein said preventing means is a coating of tacky or adhesive material.

15. In combination with upholstered furniture having a back, sides, and cushioned seat and a crevice formed below the cushioned seat and adjacent the back or sides,and a stabilizing device for holding a fabric cover on the cushioned seat comprising:

an elongated V-shaped member having a nose and a pair of arms forming the V-shape, wherein said member is formed of an elastic, polymeric material and having a length substantially approximating that of the width of said cushioned seat, said pair of arms being movable from a first naturally open stable position to a second closed unstable position, wherein said elongated V-shaped member is inserted within the crevice with the nose pointed inwardly toward the crevice and the arms extending outwardly away from the crevice so that insertion of the V-shaped member into the crevice has been facilitated, and wherein a portion of the fabric cover is disposed within the crevice around the stabilizing device and held within the crevice by an outward biasing action exerted from the arms.

16. The stabilizing device according to claim 15, wherein in said second closed position said pair of arms are adjacent to one another.

17. The stabilizing device according to claim 16, wherein in said first open position said pair of arms are spaced apart from one another and an outer surface of at least one of said pair of arms have means for preventing said fabric cover from moving with respect to said at least one of said pair of arms by creating frictional forces between said cover and said outer surface.

18. The stabilizing device according to claim 17, wherein said elastic material has a shore A durometer hardness ranging from 50–90.

19. The stabilizing device according to claim 18, wherein said elastic material is polyvinylchloride.

20. The stabilizing device according to claim 15, wherein said elongated member has a substantially constant V-shaped cross-section along its entire length.

21. In combination with upholstered furniture having a back, sides, and cushioned seat, and a crevice formed below the cushioned seat and adjacent at least one of the back and sides, and at least one stabilizing device for holding a fabric cover on the cushioned seat comprising:

an elongated close-shaped member having a circumferentially closed perimeter with at least three sides and angles forming the closed-shape, said member being made of an elastic, polymeric material and having a width and a length, wherein said length is greater than said width, wherein said stabilizing device is inserted within the crevice so that a portion of the fabric cover is disposed within the crevice around the stabilizing device and held therein.

22. The stabilizing device according to claim 21, wherein said elongated member has a triangular shaped cross-section.

23. The stabilizing device according to claim 22, wherein said elastic material is polyvinylchloride.

24. The stabilizing device according to claim 21, wherein said elongated member has a diamond shaped cross-section.

25. The stabilizing device according to claim 21, wherein an outer surface of said elongated member have means for preventing a fabric cover from moving with respect to said elongated member by creating frictional forces between said fabric cover and said outer surface.

26. The stabilizing device according to claim 25, wherein said preventing means is a plurality of ribbed projections.

27. The stabilizing device according to claim 25, wherein said preventing means is a coating of tacky or adhesive material.

28. The stabilizing device according to claim 21, wherein said elastic material has a shore A durometer hardness ranging from 50–90.

29. The stabilizing device according to claim 21, wherein said elongated member has a substantially constant closed-shaped cross-section along its entire length.

30. A stabilizing device comprising:

an elongated hollow member having a closed perimeter and including at least three sides and included angles, said member being made of an elastic, polymeric material and having a length and a width, said length being greater than said width, wherein each formed side can be flexed in movement when pressure is applied so as to aid in retaining a fabric cover on a cushioned seat when at least one of said members is received within a crevice formed below a cushion and adjacent the back or sides of an upholstered piece of furniture when the fabric cover is positioned over a cushioned seat with a portion of the cover disposed within the crevice around the stabilizing device.

31. The stabilizing device according to claim 30, wherein said elongated member has a triangular cross-section.

32. The stabilizing device according to claim 30, wherein said elongated member has a diamond cross-section.

33. The stabilizing device according to claim 30, wherein said elongated member has a circular cross-section.

34. The stabilizing device according to claim 30, wherein an outer surface of said elongated member have means for preventing a fabric cover from moving with respect to said elongated member by creating frictional forces between said fabric cover and said outer surface.

35. The stabilizing device according to claim 34, wherein said preventing means is a plurality of ribbed projections.

36. The stabilizing device according to claim 34, wherein said preventing means is a coating of tacky or adhesive material.

37. The stabilizing device according to claim 30, wherein said elastic material has a shore A durometer hardness ranging from 50–90.

38. The stabilizing device according to claim 30, wherein said elastic material is polyvinylchloride.

39. The stabilizing device according to claim 30, wherein said elongated member has a substantially constant cross-section along its entire length.

40. In combination with upholstered furniture having a back, sides, and cushioned seat and a crevice formed below the cushioned seat and adjacent the back or sides, and a stabilizing device for holding a fabric cover on the cushioned seat comprising:

an elongated V-shaped member having a nose and a pair of arms forming the V-shape, wherein said member is formed of an elastic, polymeric material having a length greater than its width, said pair of arms being movable from a first naturally open position to a second closed unstable position, wherein said elongated V-shaped member is inserted within the crevice with the nose pointed inwardly toward the crevice and the arms extending outwardly from the crevice so that the insertion of the V-shaped member into the crevice has been facilitated, and wherein a portion of the fabric cover is disposed within the crevice around the stabilizing device and held within the crevice by an outwardly biasing action exerted from the arms.

* * * * *

UNITED STATES PATENT AND TRADEMARK OFFICE

CERTIFICATE OF CORRECTION

PATENT NO. : 5,547,249
DATED : August 20, 1996
INVENTOR(S) : Paula Riley, et. al.

It is certified that error appears in the above-indentified patent and that said Letters Patent is hereby corrected as shown below:

Title page, item [57], Abstract: delete the word "timber" and insert therefor the word--member--.

Column 1, line 26, delete the word "siring" and insert the word --sitting -- Column 3, line 4, delete the word "an" and insert the word --art--.

Signed and Sealed this

Eleventh Day of February, 1997

Bruce Lehman

*Attest:*

BRUCE LEHMAN

*Attesting Officer*

*Commissioner of Patents and Trademarks*